US006802147B2

(12) United States Patent
Haefeli et al.

(10) Patent No.: US 6,802,147 B2
(45) Date of Patent: Oct. 12, 2004

(54) DEVICE FOR FIREARMS AND FIREARM

(75) Inventors: Hans Viktor Haefeli, Döttingen (CH); Peter Kressibucher, Watt (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 10/453,216

(22) Filed: Jun. 3, 2003

(65) Prior Publication Data

US 2004/0107620 A1 Jun. 10, 2004

(30) Foreign Application Priority Data

Jun. 12, 2002 (CH) ..... 2002 1000/02

(51) Int. Cl.[7] ..... F41A 9/53
(52) U.S. Cl. ..... 42/1.05; 42/1.01; 89/27.12
(58) Field of Search ..... 42/1.05, 1.01, 42/1.04, 70.01; 89/27.12

(56) References Cited

U.S. PATENT DOCUMENTS 4,147,055 A 4/1979 Wood et al.
4,664,013 A * 5/1987 Wegner et al. ..... 89/6.5
4,836,672 A * 6/1989 Naiman et al. ..... 356/5.06
5,016,518 A * 5/1991 Kaplan et al. ..... 89/8
5,233,903 A * 8/1993 Saphier et al. ..... 89/8
5,282,454 A 2/1994 Bell et al.
5,301,448 A * 4/1994 Petrick et al. ..... 42/70.01
5,425,299 A * 6/1995 Teetzel ..... 89/14.4
5,735,070 A * 4/1998 Vasquez et al. ..... 42/1.02
5,825,948 A * 10/1998 Sirkis et al. ..... 385/12

* cited by examiner

*Primary Examiner*—Jack Kem
*Assistant Examiner*—Gabriel S. Sukman
(74) *Attorney, Agent, or Firm*—McCormick Paulding & Huber LLP

(57) ABSTRACT

A device for firearms (1) and a firearm (1) having this device are disclosed. The device is used for detecting a state in the space (10) and for transmitting a signal correlated to the state. The device has a sensor region (24.1, 24.2) for detecting the state and a conductor arrangement (24.3), connected to the sensor region (24.1, 24.2) for transmitting the signal. The sensor region (24.1, 24.2) and the conductor arrangement (24.3) are formed by a fiber-optic system (24). The device also has a movable indicator (17), whose position corresponds to the state to be detected in the space (10) to be monitored and is detectable by the sensor region (24.1, 24.2). The sensor region (24.1, 24.2) of the fiber-optic system is protected by a shield (20).

28 Claims, 10 Drawing Sheets

DEVICE FOR FIREARMS AND FIREARM

CROSS REFERENCE TO PRIOR APPLICATION

Applicant hereby claims foreign priority under 35 U.S.C. §119 from Swiss Patent Application No. 2002 1000/02 filed 12, Jun. 2002, the disclosure of which is herein incorporated by reference.

BACKGROUND OF THE INVENTION

The present invention relates to a device for firearms, and the firearm itself, for detecting a state or condition and transferring an optical signal which is correlated to the state in a space to be monitored.

On firearms, particularly on semiautomatic and automatic firearms such as cannons, sensors are used at multiple points for the purpose of detecting signals during the use of the firearms, in order to monitor the firearms, particularly during firing. Specifically, the sensors detect signals in this case which are correlated to states in spaces to be monitored. Transmission units are generally connected to the sensors in order to transmit the signals detected. The transmitted signals are used for various purposes; they may merely be used for the purpose of giving the operating personnel information about the state detected, but they may also be used in a control loop or regulating circuit in order to, for example, check a sequence of functions in the framework of firing shots.

States to be detected may be positions of mechanical weapon components, which are present in the spaces to be monitored only temporarily and/or in various components of their mass, for example. Examples of these are slide positions, breech positions, clutch positions, trigger positions, and drum positions, but filling states of cartridge chambers, for example, may also be monitored in this way.

Examples of the utilization of the signals, which describe the states cited or other states, are the direct change of a movement state, i.e., the initialization, change, or termination of a movement of a weapon part, or the construction of a control loop or a regulating circuit. Firearms like cannons may, for example, have a gas drive as an intrinsic drive and also have an electric drive for the ammunition supply, the gas drive and electric drive operating independently of one another and therefore their controls having to be linked to one another by a regulating circuit for flawless functioning of the firearm.

Mechanical, inductive, capacitive, or magnetic devices are typically used on firearms as sensors for the purposes cited above, but these are not suitable for modern automatic weapons having a higher cadence in particular. In such firearms, high shock-like stresses and alternating stresses of high frequency arise, which leads to sensitive parts of typical construction, like the devices just cited, not functioning properly and/or having only a brief service life. In this case, the devices positioned directly on the weapon barrel are subjected to particularly high wear.

Firearms which have sensor devices having fiber-optic systems are known from U.S. Pat. Nos. 5,425,299 and 5,735,070. These have the disadvantage that the sensitive regions of the fiber-optic systems are not shielded, so that they do not operate or do not operate reliably in the event of even slight contamination, as typically occurs in weapons.

SUMMARY OF THE INVENTION

It is therefore the object of the present invention, to provide a device of the type initially cited, which does not have the disadvantages cited above and using which a long service life may be achieved with precise function even for weapons having a higher cadence; and to suggest an improved firearm of the type initially cited.

This object is achieved according to the present invention by a device for firearms for detecting a state in a space to be monitored and for transmitting a signal correlated to the state by a fiber-optic system. The system has a sensor region and a conductor arrangement formed by a fiber-optic system, and the sensor region is protected by a shielding device.

The object is also achieved by means of a firearm having at least one device for detecting a state in a space to be monitored for transmitting a signal correlated to the state. The device includes a sensor region and conductor arrangement formed by a fiber-optic system, and the sensor region is protected by a shielding device.

Using the present invention, it is possible to make highly sensitive fine mechanisms suitable for an object which is subjected to high and strongly oscillating mechanical stresses, specifically for a firearm, even one having a high cadence.

Therefore, the device according to the present invention and/or the firearm equipped therewith has, instead of typical mechanical, inductive, capacitive, magnetic, or electrical devices, a fiber-optic system, which has been shown to be resistant to shock stresses and vibrations. The resistance to shocks and vibrations is achieved in that, among other things, the fibers joined into bundles for the fiber-optic system are used in a number of, for example, up to 100 or up to 200 fibers, each fiber having a diameter of 12 $\mu$m, for example.

The states to be detected in the space to be monitored are typically scannable states. The scannable states to be detected are to be understood as both the position of a material element and a pressure in a pressure vessel, a material element able to be scanned directly and a pressure in a pressure vessel able to be scanned through a displaceable piston.

Fiber-optic systems only operate correctly if they are not impaired. In this case, impairments to be feared are less mechanical damage than contaminations. However, there is frequently a significant danger of contamination in firearms; the fiber-optic systems may be affected by material of many types, such as dust, soot, liquids such as lubricants, for example, graphite grease, and vapors, very generally contaminations in solid and liquid form. In order to avoid malfunction as a consequence of such impairments, the fiber-optic systems are shielded in that at least their sensor region is protected by a shielding device, which may be either a wall positioned in a suitable way or a chamber.

In order to avoid misunderstandings, it is to be expressly noted that such a chamber is not the space to be monitored, in which a state may be determined by the novel device, and is also not the pressure vessel cited above, but rather is a region shielded from contamination, in which at least the sensor region of the fiber-optic system is positioned.

An indicator, which senses the state to be detected directly or indirectly and adjusts its position as a function of the state, indicates the state to be detected in the space to be monitored. The position of the indicator is registered by the sensor region of the fiber-optic system.

In principle, two optical methods are considered for detecting the position of the indicator. In the first method, the particular position of the indicator is detected directly, in that the sensor region of the fiber-optic system forms a light barrier into which the indicator projects in certain positions; the fiber-optic system generates a signal when the indicator assumes a special position; the indicator may either be implemented compactly in this case and interrupt the otherwise detectable light beam in the special position, or the indicator may have an opening through which the otherwise interrupted light beam passes. A mirror effect is used in the second method for detecting the position of the indicator.

There are various variants for the implementation, arrangement, and mode of operation of the indicator, of which the preferable ones are described in the following.

The position of the indicator is determined by a feeler, which in turn senses the state in the space to be monitored, generally in that it scans it mechanically. The indicator and the feeler may form different components which move at least partially in solidarity, or they may be in one piece. The feeler thus scans the state to be detected in the space to be monitored, through which its position and therefore the position of the indicator are determined. The sensor region of the fiber-optic system registers, as already described, the position of the indicator.

The chamber in which at least the sensor region of the fiber-optic system is positioned is not a completely closed capsule, but rather it has an inlet and/or opening, through which the indicator projects into the chamber.

For a reliable mode of operation of the device it is imperative that this inlet and/or opening is implemented in a suitable way. Firstly, the inside of the chamber is to be prevented from becoming so unclean that the sensor region of the fiber-optic system no longer operates flawlessly; the inlet must therefore be provided with a sealing arrangement. Secondly, return of the feeler, which generally occurs under the force of a return spring, must occur without friction or at least with as little friction as possible; the sealing arrangement must therefore be implemented so that the return of the feeler is not hindered by frictional forces.

In order to use the signals detected by the fiber-optic system, which describe the state in the space to be monitored, it is advantageous to convert these optical signals into electrical signals, for which an optical/electrical converter device may be provided. This converter device and possibly the devices connected thereto may be more sensitive to shock and vibration than the fiber-optic system, but this may be accepted in this case, because these devices may be positioned without problems outside those regions of the firearm in which the especially high shock and vibration stresses occur.

The signals sensed and transferred according to the description above, which are a function of the position of the feeler and/or of the indicator and therefore a function of the state to be detected in the space to be monitored, are generally a certain type of "digital" and/or qualitative signal; for example, such signals indicate whether a component of the firearm occupies a specific setting or not or whether a specific cartridge chamber is occupied by a cartridge or not. However, in certain cases it is advantageous to also detect the state in the space to be monitored quantitatively. In an advantageous refinement of the device according to the present invention, the fiber-optic system is laid out for the purpose of being able to also detect and transfer signals which contain more precise information, like quantitative signals.

For example, at least one further feeler and/or at least one further indicator may be provided, which work together with a further sensor region of the fiber-optic system. Such an arrangement may be used in various ways. Firstly, if the space to be monitored is a cartridge chamber, for example, it may be detected not only whether this cartridge chamber is occupied by cartridge or not, but the length and therefore the type of the cartridge located in the cartridge chamber may also be detected qualitatively. Secondly, the arrangement may also be used as a double safety.

The level of a pressure in a pressure vessel may also be detected quantitatively in that the position of a corresponding indicator is detected by one or more sensor regions.

More precise information about the state to be detected in the space to be monitored may also be obtained if the indicator has markings, for example barcodes, in various adjoining regions, of which one or another marking may be read by the fiber-optic system, depending on the position of the indicator.

BRIEF DESCRIPTION OF THE DRAWINGS

In the following, the present invention is described in detail on the basis of examples and with reference to the drawing, which form an integral part of the present disclosure.

FIG. 2AA shows a detail of FIG. 2A;

DESCRIPTION OF THE PREFERRED EMBODIMENTS

Figure 1A:
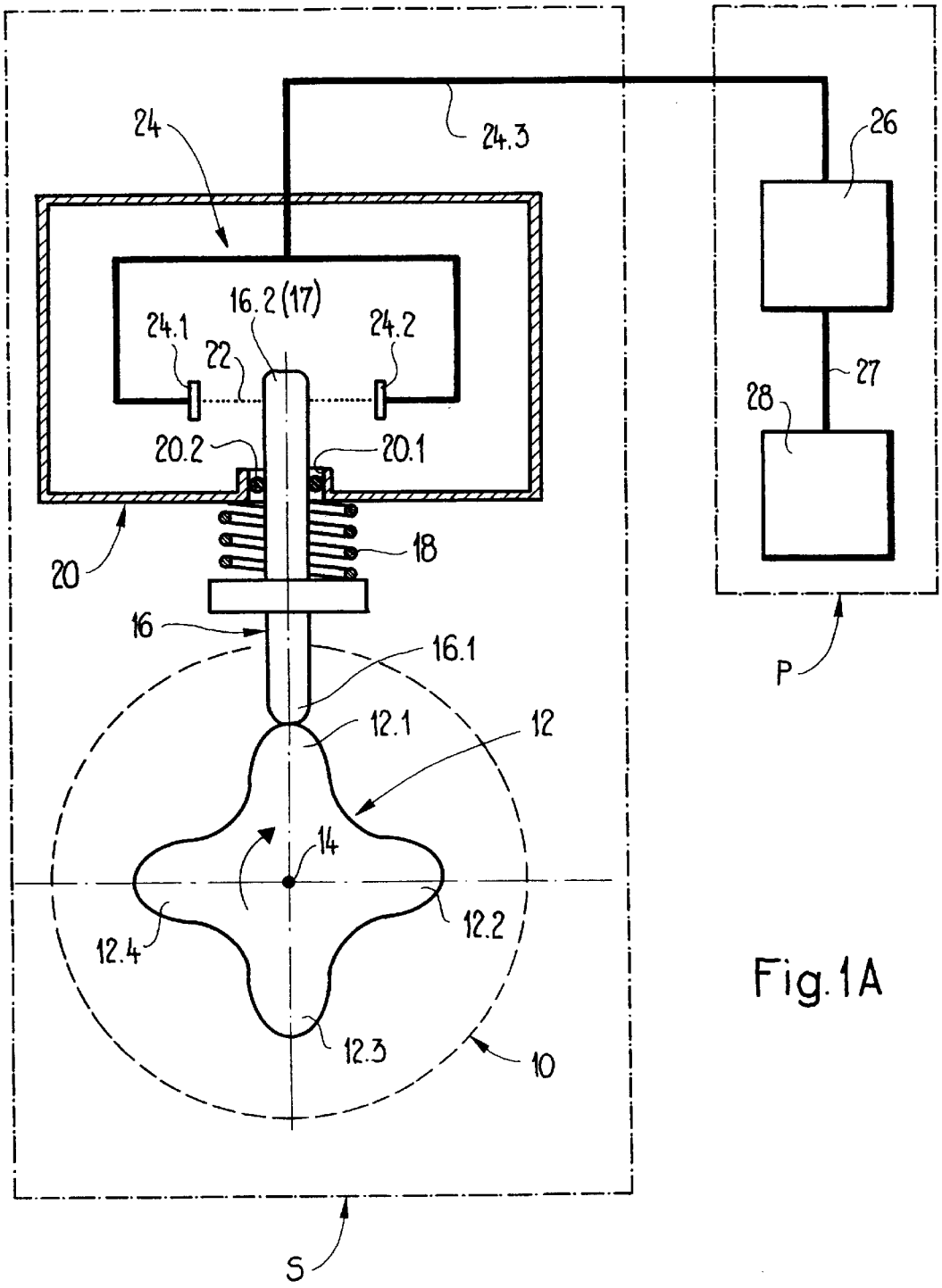
FIG. 1A shows a first exemplary embodiment of a device according to the present invention, in a greatly simplified, schematic illustration.

FIGS. 1A to 1E are used for explaining the principle of the present invention. FIG. 1A shows a space 10 to be monitored, which is located on a weapon (not shown) in a region S subject to shock and vibration. A cam wheel 12, having four cams 12.1 to 12.4, which is rotated around an axis 14, shown in FIG. 1 as point 14, is positioned in the space 10. In the present case, the angular position of the cam wheel 12 is considered a state to be detected in the space 10. A mechanical feeler 16 has a feeler part 16.1, which, in any of its possible positions, is located in the space 10 and touches the cam wheel 12 on its contour. The mechanical feeler 16 is pre-tensioned on the cam wheel 12 using a spring device 18. A second feeler part 16.2 of the mechanical feeler 16 projects, at least in the uppermost position which the mechanical feeler 16 may assume, through an inlet 20.1 into a chamber 20, which forms a shielding device for a fiber-optic system 24. The second feeler part 16.2 forms an indicator 17.

A sealing device 20.2 is used for the purpose of keeping gaseous, liquid, and solid material, which could impair the functioning of devices positioned in the chamber 20, out of the chamber 20. Since the volumes are generally small, there is usually no problem caused by condensation. The sealing device 20.2 achieves a tightly sealed but simultaneously frictionless or at least very low friction mutual contact of two surfaces, generally shaped like cylinder jackets, which move relative to another.

Preferably, one of these surfaces is provided with a sealing arrangement and the other of these surfaces is provided with the best surface polish. One surface and/or the sealing arrangement 20.2 may have sealing compounds, O-rings, or Teflon sealing rings; the other surface may, for example, be a finely polished metal surface.

The indicator 17 may have a diameter of approximately 4 mm to approximately 15 mm, at least in the region which is pushed through passage 20.1. The radial thickness of a ring, made of Teflon, for example, which is suitable for a sealing compound, may be approximately 0.5 mm and its axial width may be approximately 1 mm. The polished surface may have the quality 3M when polished. These numbers are only examples and are in no way understood to be as restrictive.

In its position illustrated in FIG. 1A, the mechanical feeler 16 projects far enough into the chamber 20 that its second feeler part 16.2 and/or the indicator 17 interrupts a light beam 22 of a light barrier 24.1, 24.2, this light barrier forming the sensor region of the fiber-optic system 24. Like the space 10, the chamber 20 is also in the region A of the weapon subject to shock and vibration. The fiber-optic system 24 is implemented in such a way that it provides an optical signal which is directly a function of the position of the indicator 17 and/or the feeler 16 and indirectly a function of the angular position of the cam wheel 12, and is therefore correlated to the mechanical state in the space 10 to be monitored. As shown in FIG. 1A, the feeler 16 is in its uppermost position when the cam wheel 12 assumes a setting in which two diametrically opposed cams, e.g., the cams 12.1 and 12.3, are on a vertical connection line through the point 14, and the other two cams 12.2 and 12.4 are on a horizontal connection line through the point 14. A conductor arrangement 24.3 of the fiber-optic system 24 leads out of the chamber 20 and is coupled to an optical/electronic converter 26, which is used for the purpose of converting the optical signal, detected by the sensor region and/or the light barrier 24.1, 24.2 of the fiber-optic system 24 and transmitted by the conductor region of the fiber-optic system 24, into an electrical signal. The electrical signal is supplied via a line 27 to a computer unit 28, which is implemented for the purpose of using this electrical signal.

The optical/electrical converter 26 and the computer unit 28 are in a region P of the weapon and/or a weapon system which the weapon is a part of, which is subjected to shock or vibration less than the region A or not at all, or in which it is at least possible to provide damping devices (not shown) in order to reduce the effects of shocks and vibrations on the devices described individually and possibly on further devices.

Figure 1B:
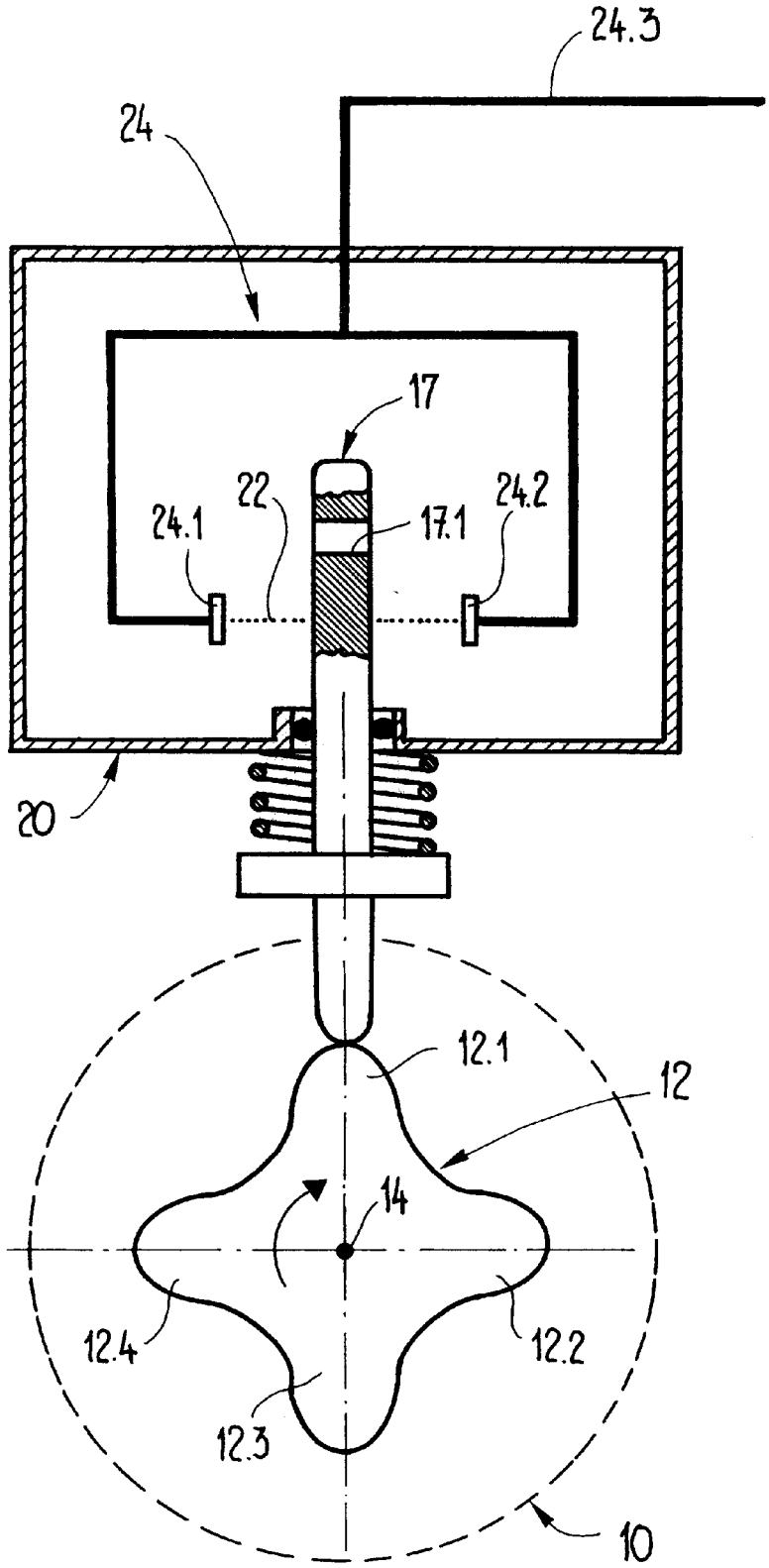
FIG. 1B shows a second exemplary embodiment of a device according to the present invention, in a greatly simplified, schematic illustration.

FIG. 1B shows another exemplary embodiment of the device according to the present invention, in which the sensor region of the fiber-optic system 24 is also formed by a light barrier 24.1, 24.2. The indicator 17 is implemented and positioned in such a way that in most of its settings it interrupts the light beam 22 of the light barrier 24.1, 24.2 of the fiber-optic system 24. The indicator 17 has an opening 17.1; in a special position, which corresponds to a special state in the space 10 to be monitored, the indicator 17 is in a setting in which its opening 17.1 opens the path to the light beam 22 of the light barrier 24.1, 24.2 of the fiber-optic system 24.

Figure 1C:
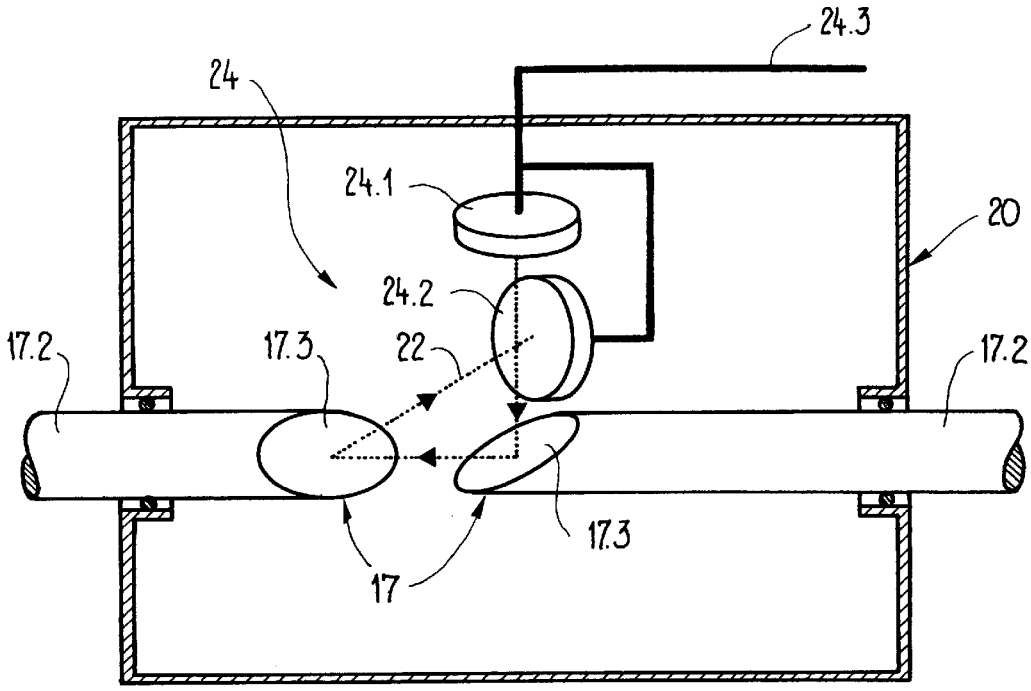
FIG. 1C shows a third exemplary embodiment of a device according to the present invention, in a greatly simplified, schematic illustration.

A further exemplary embodiment of the novel device is illustrated in FIG. 1C. The light barrier 24.1, 24.2 is implemented here in such a way that its two elements are not position aligned, but rather transversely and/or diagonally to one another. The indicator 17 has two pin-shaped indicator parts 17.2, each of which has an end region which acts as a partial reflection surface of a reflection surface 17.3. In a special position of the two-part indicator 17, which corresponds to a special state in the space 10 to be monitored, the reflection surfaces 17.3 work together in such a way that the light beam 22 of the light barrier 24.1, 24.2 is deflected from one element 24.1 of the light barrier to the other element 24.2 of the light barrier, as indicated by the dotted line.

Figure 1D:
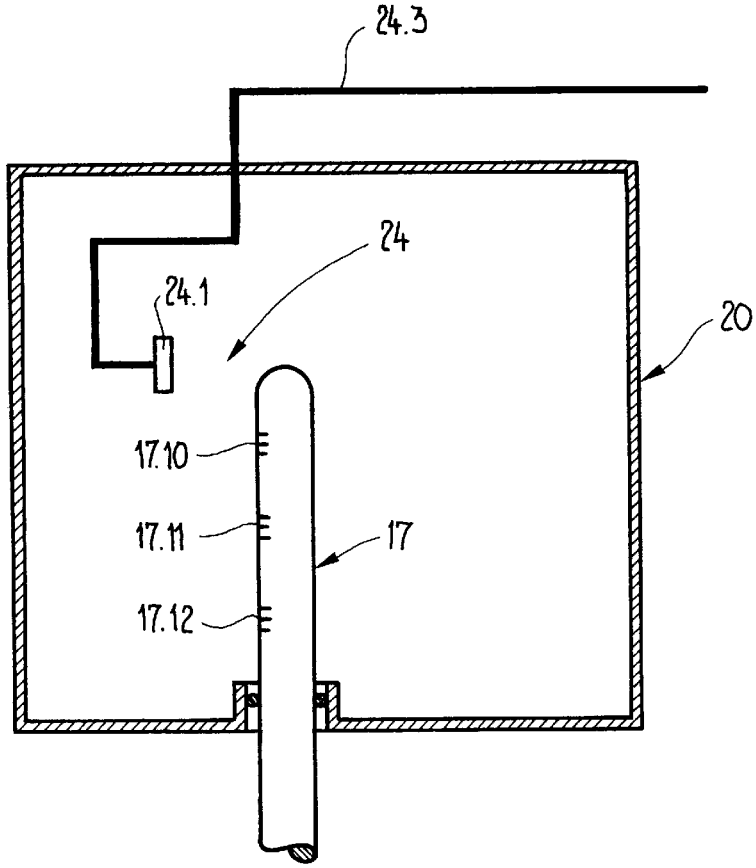
FIG. 1D shows a fourth exemplary embodiment of a device according to the present invention, in a greatly simplified, schematic illustration.

FIG. 1D shows yet a further exemplary embodiment of the novel device, in which the indicator 17 is implemented in such a way that it has multiple indicator regions 17.10, 17.11, 17.12. Each of the indicator regions 17.10, 17.11, 17.12 has a marking which is recognizable by the sensor region 24.1 of the fiber-optic system 24. In this way, the state in the space 10 to be monitored may be detected in a quantified way, either in that the markings are different and may be recognized and/or read by the sensor region of the fiber-optic system 24, or in that the markings are counted. Furthermore, it is possible, through coupling to a time measurement, to determine the speed of a change of the state in the space 10 to be monitored, in that the number of the markings recognized per unit of time is established. Instead of detectable and/or readable markings, the indicator 17 may also have multiple openings, which, in a suitable position, allow the passage of an otherwise interrupted light beam of a light barrier.

Figure 1E:
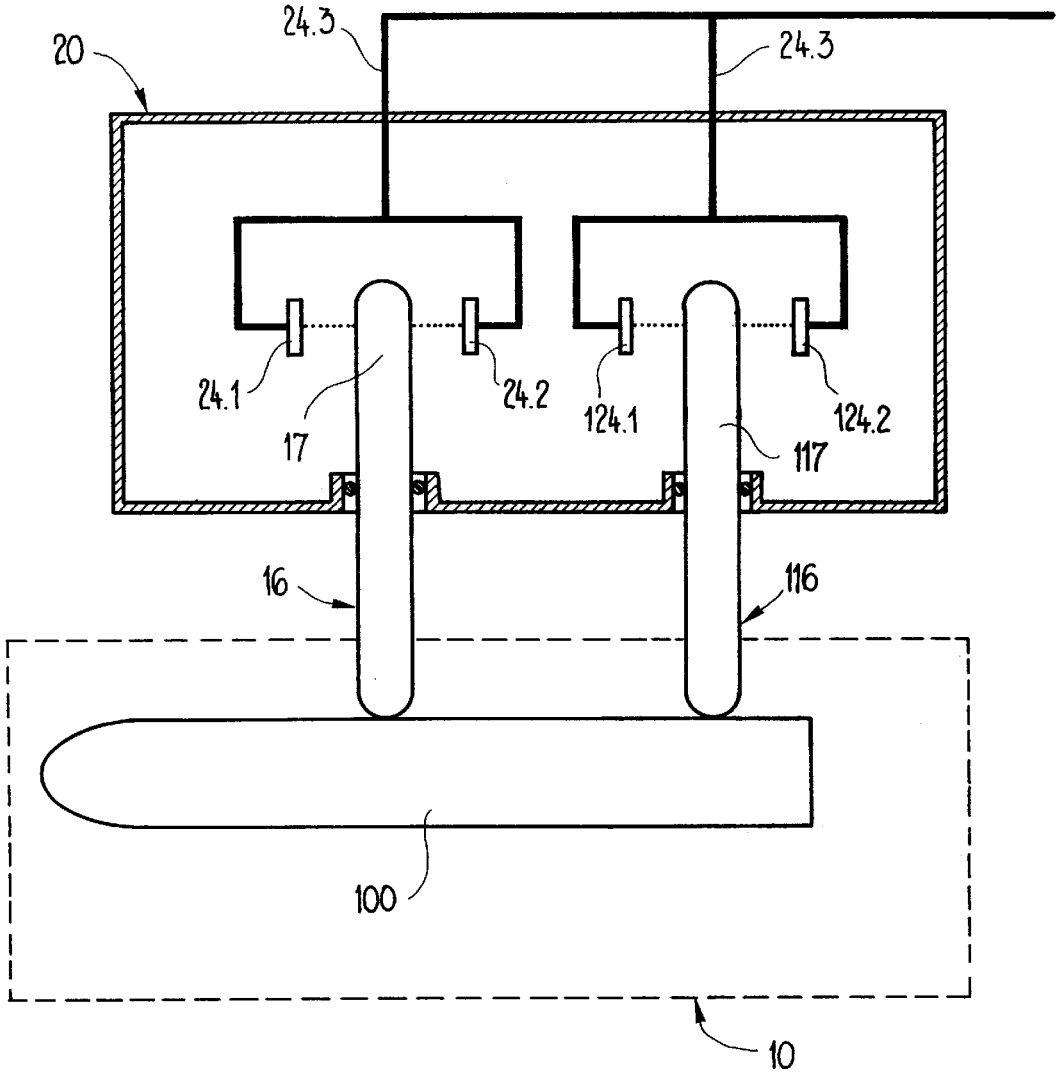
FIG. 1E shows a further exemplary embodiment of a device according to the present invention, which works together with a further device according to the present invention, in a greatly simplified, schematic illustration.

FIG. 1E shows a further exemplary embodiment of a device according to the present invention, which has the feeler 16 and/or indicator 17 and the fiber-optic system 24 with the sensor region having a light barrier 24.1, 24.2. In addition, a second feeler 116 and/or indicator 117 and a second light barrier 124.1, 124.2 are provided as a second sensor region. The space 10 to be monitored is a cartridge chamber, and the state to be monitored is the presence of a cartridge 100. If a section of a cartridge was located neither in the region of the first feeler 16 and/or indicator 17 nor in the region of second feeler 116 and/or indicator 117 in the cartridge chamber, neither of the light barriers 24.1, 24.2 and/or 124.1, 124.2 would detect the associated indicator 17 and/or 117. If cartridge 100 is completely in the cartridge chamber, as shown in FIG. 1E, the light barrier 24.1, 24.2 detects both the indicator 17 and the indicator 117.

Figure 2:
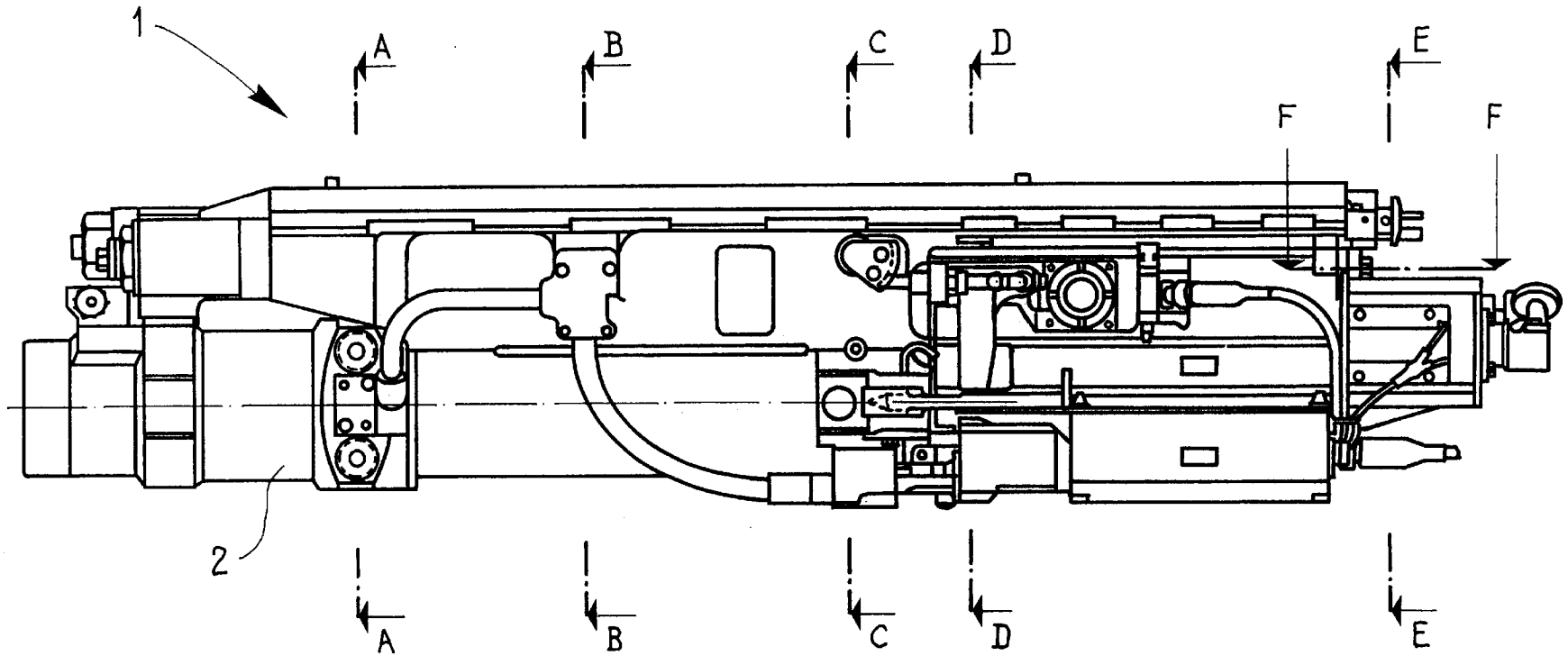
FIG. 2 shows a part of a firearm which has multiple devices according to the present invention.

A section of an automatic firearm 1 having a weapon barrel 2 is illustrated in FIG. 2. The firearm 1 has multiple devices according to the present invention, each of which is used for the purpose of monitoring a specific space and detecting the state existing there. The points at which the devices are positioned are indicated by section lines A—A, B—B, C—C, D—D, E—E, and F—F.

Figure 2A:
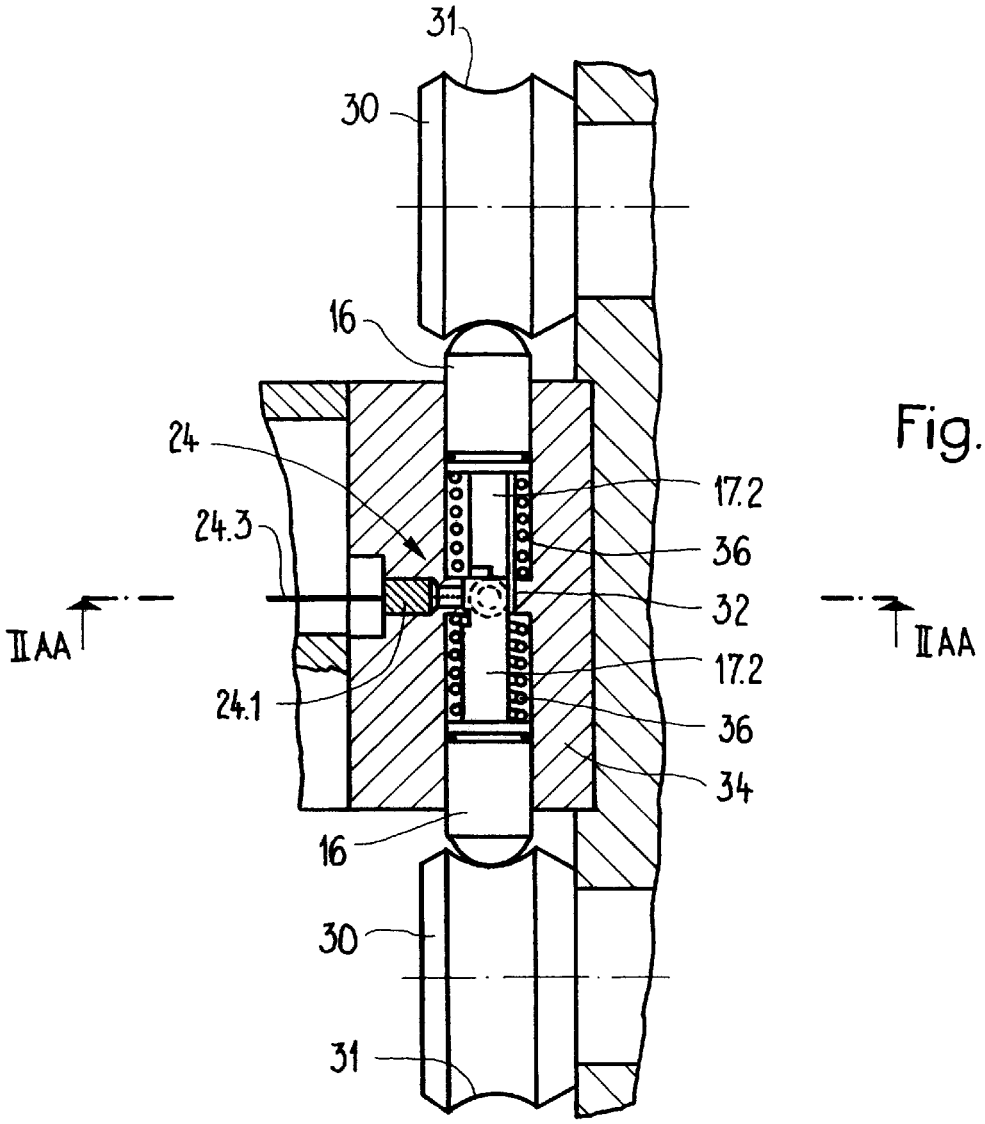
FIG. 2A shows the firearm illustrated in FIG. 1 in a section along the line A—A of FIG. 2, greatly simplified, to illustrate a first of the devices of the firearm illustrated in FIG. 2.
Figure 2A:
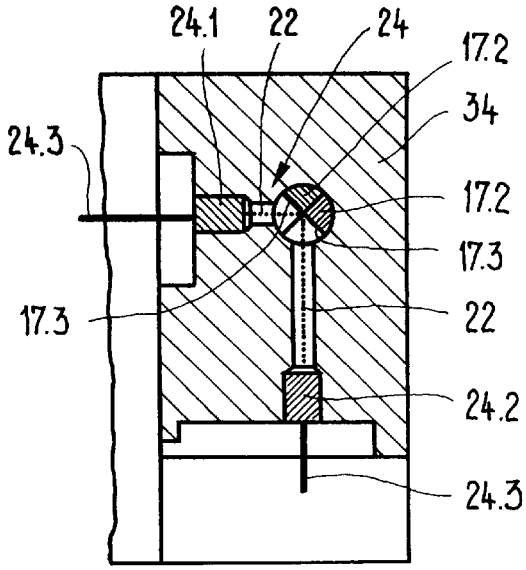

FIG. 2A shows the section A—A of FIG. 2, having one of the devices according to the present invention, in which the state to be detected is the locking and/or unlocking of the weapon barrel 2. FIG. 2A shows the section IIA—IIA of FIG. 2A. In the locked state of the weapon barrel 2, two locking elements 30 are in the position shown in FIG. 2A, from which they are displaced to the left in the unlocked state. The indicator 17 is implemented here in two parts and has two pin-like indicator parts 17.2, which are movably positioned in an opening 32 of a body 34. The ends of indicator parts 17.2 projecting out of the opening 32 engage in grooves 31 of the locking element 30 as long as the locking elements 30 are in the locked setting. If they are not locked, the locking elements are displaced to the left from their position shown in FIG. 2A, which has the consequence that the indicator parts 17.2 are displaced in the opening 32, first toward the inside of the opening 32 and, upon further displacement of the locking elements 30, out of the opening 32 under the force of springs 36. Correct locking only exists if the locking elements 30 and therefore the indicator parts 17.2 are located in the position illustrated in FIG. 2A.

In the present exemplary embodiment shown in FIG. 2A, the position of the indicator 17 and/or of the indicator parts 17.2 is not detected directly by the sensor region 24.1, 24.2 of the fiber-optic system 24, but rather a mirrored surface and/or reflection surface 17.3 is used, with the aid of which the sensor regions 24.1, 24.2 of the fiber-optic system 24 recognize that the locking exists. The mirrored surface and/or reflection surface 17.3 is continuous and flat and it includes, as illustrated in FIG. 2AA, two partial reflection surfaces, movable in relation to one another, which are produced on the diametrically opposite inner ends of the indicator parts 17.1. These inner ends of the indicator parts 17.1 are not circular in cross-section, but rather have the shape of only a quarter circle, and they are positioned complementarily, so that they may be displaced in the same length region of the recess 32 upon locking; in this case, one semicircle of the cross-sectional area of the recess 32 is occupied by both of the inner ends of the indicator parts 17.1. The remaining semicircle of the cross-sectional area of the recess 32 remains empty and forms a space for the beam 22 of the light barrier 24.1, 24.2, whose two light barrier units are positioned diagonally in this case. Only in the complete and/or secure locking state, i.e., when the inner ends of the indicator parts 17.1 form the continuous reflection surface 17.2, may the beam of the light barrier 22 be reflected and the signal corresponding to the locked state be generated by the fiber-optic system 24.

The locked state is therefore double-checked. The fiber-optic system 24 is continued in the conductor arrangement 24.3. The mode of operation of the device shown in FIG. 2A inside a weapon controller may be seen in FIG. 3, in which it is indicated with A.

It is to be noted that the principle described above of the reflection of the beam of the light barrier may also be used in another way, for example, for simple detection and/or checking of the state. It is not necessary for the reflection surface to be composed of two partial surfaces, it may have one single surface or more than two partial surfaces, is flat, and it also does not necessarily have to be continuous. Furthermore, the two elements of the light barrier may also be positioned at an angle other than 90°, i.e., other than precisely diagonally. It is only essential that upon the occurrence of a specific state, or possibly multiple states, in the space to be monitored, the reflection surface is positioned relative to the light barrier in such a way that a reflection occurs or an existing reflection is prevented, so that a corresponding signal is generated.

Figure 2B:
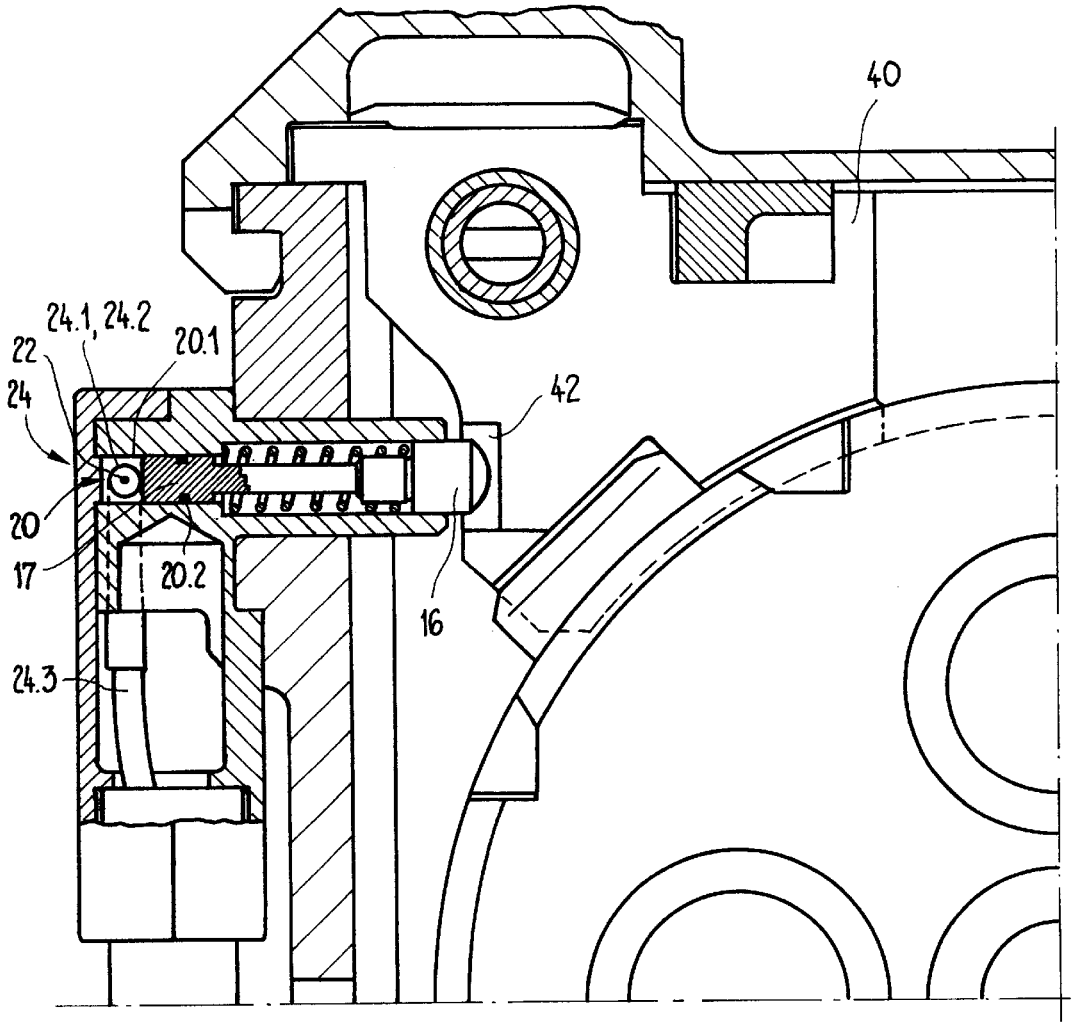
FIG. 2B shows the firearm illustrated in FIG. 1 in a section along the line B—B of FIG. 2, greatly simplified, to illustrate a second of the devices of the firearm illustrated in FIG. 2.

FIG. 2B shows the section B—B of FIG. 2, having one of the devices according to the present invention, in which the state to be monitored is the setting of a slide 40. The slide 40 acts as a clock for multiple cycles and thus forms, in a certain way, a pacemaker for the firearm 1. FIG. 2B shows the slide 40 in its forward position. A slide part 42 is in contact with a scanning pin, which forms the feeler 16. Upon a rotation of a drum 3 of the firearm 1, the slide 40 moves in the direction of the lengthwise axis of the weapon barrel 2. At the same time, the slide part 42 displaces the scanning pin and/or feeler 16. The feeler part on which the indicator 17 is implemented projects through the opening 20.1, which is provided with a sealing device 20.2, into the chamber 20. The light barrier 24.1, 24.2 forming the sensor region of the fiber-optic system 24 and the adjoining section of the conductor arrangement 24.3 of the fiber-optic system 24 are positioned in the chamber 20. The mode of operation of the device shown in FIG. 2B within a weapon controller may be seen in FIG. 3, in which it is indicated with B.

Figure 2C:
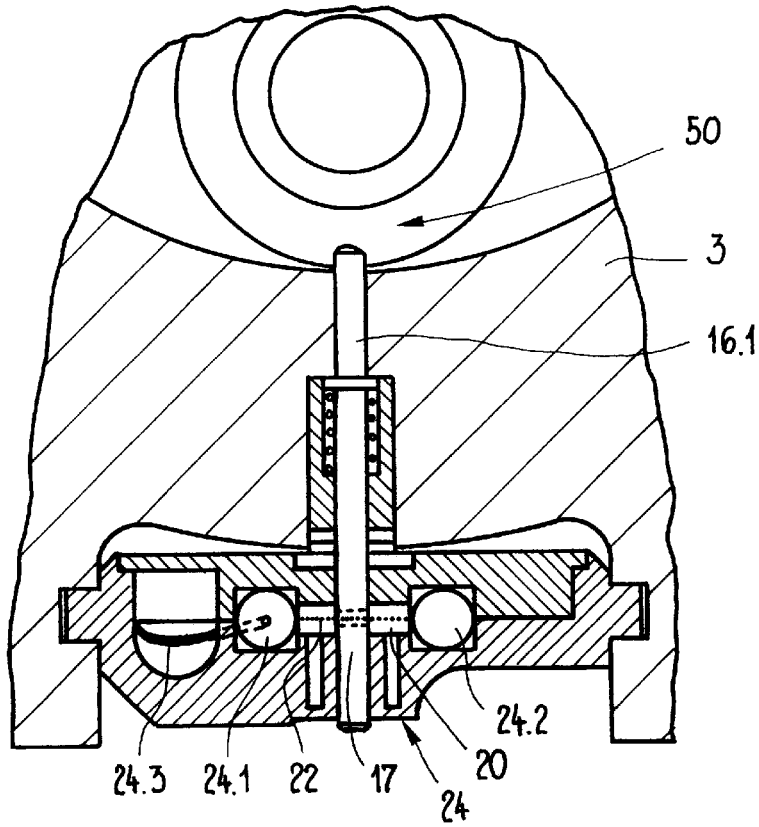
FIG. 2C shows the firearm illustrated in FIG. 1 in a section along the line C—C of FIG. 2, greatly simplified, to illustrate a third of the devices of the firearm illustrated in FIG. 2.

FIG. 2C shows the section C—C of FIG. 2 having a third arrangement of one of the devices according to the present invention. In this case, the occupation by a cartridge of a cartridge chamber 50 of the drum 3 is understood as the state to be monitored. In the arrangement illustrated in FIG. 2C, the cartridge chamber 50 is in the firing position, and a position is shown in which this cartridge chamber 50 is empty. A cartridge detection pin, which forms the feeler 16, scans whether the cartridge chamber 50 is occupied by a cartridge. The feeler part 16 projecting into the cartridge chamber 50—empty as shown in FIG. 2C—would be pushed radially out of the drum 3 by a cartridge, i.e., downward in FIG. 2C. The feeler part diametrically opposite the feeler part 16.1 forms the indicator 17 and projects into the chamber 20. In this case as well, the light barrier 24.1, 24.2 forming the sensor region of the fiber-optic system 24 and the adjoining section of the conductor arrangement 24.3 of the fiber-optic system 24 are positioned in the chamber 20. The mode of operation of the device shown in FIG. 2C within a weapon controller may be seen in FIG. 3, in which it is indicated with C.

Figure 2D:
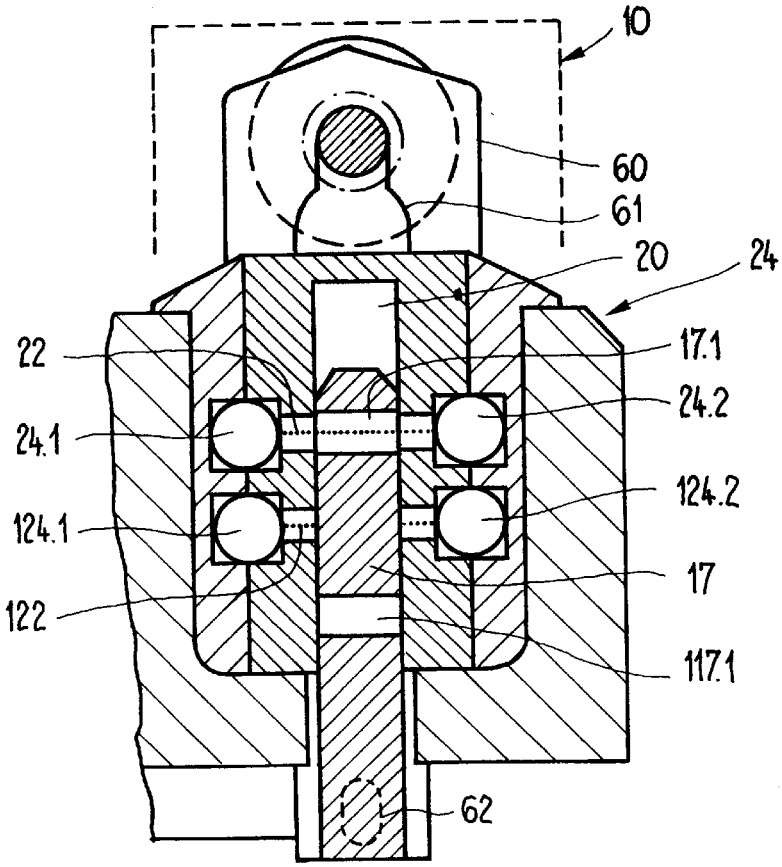
FIG. 2D shows the firearm illustrated in FIG. 1 in a section along the line D—D of FIG. 2, greatly simplified, to illustrate a fourth of the devices of the firearm illustrated in FIG. 2.

FIG. 2D shows the section D—D of FIG. 2, having a fourth arrangement of one of the devices according to the present invention, using a redundant arrangement. In this case, the setting of a firing pin 60 is understood as the state be monitored. In this arrangement, the position of the firing pin 60 itself is not established by the sensor region, but rather the position of a signal pin, the signal pin playing the role of the indicator 17 and being positioned so that its axis is parallel to the firing pin 60. The firing pin 60 has an oblong hole 61, and its movement may be coupled in the axial direction for translational movement with the signal pin and/or indicator 17, with the aid of an oblong hole 61 and coupling clips 62, 64.

The signal pin and/or indicator 17 is implemented and positioned here so that it works together with the first light barrier 24.1, 24.2 and/or the sensor region and with a second light barrier 124.1, 124.2 and/or a further sensor region of the fiber-optic system 24. For this purpose, the signal pin and/or indicator 17 has two openings 17.1, 17.101, running transversely to its lengthwise direction. If the signal pin and/or indicator 17 is positioned as shown in FIG. 2D, the beam 22 of the light barrier 24.1, 24.2 passes through the opening 17.1 and is therefore not interrupted. The beam 122 of the light barrier 124.1, 124.2 is simultaneously interrupted by the signal pin and/or indicator 17, since the second opening 17.1 is not in the path of this beam 122.

The circuit is such that the signal of the light barrier 24.1, 24.2 corresponds to a position of the signal pin and/or indicator 17 which indicates whether the firing pin is secured or unsecured, the interrupted beam 122 of the light barrier 124.1, 124.2 corresponding to a position of the signal pin and/or indicator 17 which indicates that the firing pin 60 is secured. Conversely, an interrupted light beam 22 of the light barrier 24.1, 24.2 and an uninterrupted light beam 122 of the light barrier 124.1, 124.2 indicates that the firing pin 60 is unsecured.

The state to be determined in the space 10 to be monitored is thus detected doubly. It is obvious that the circuit may also be reversed. The device shown in FIG. 2D and/or its mode of operation may be seen in FIG. 3, in which it is indicated using D1 and D2. It is also to be noted that using a different circuit, but the same indicators and the same sensor region of the fiber-optic system, a simultaneously acting double securing arrangement may also be implemented instead of a redundant arrangement.

Figure 2E:
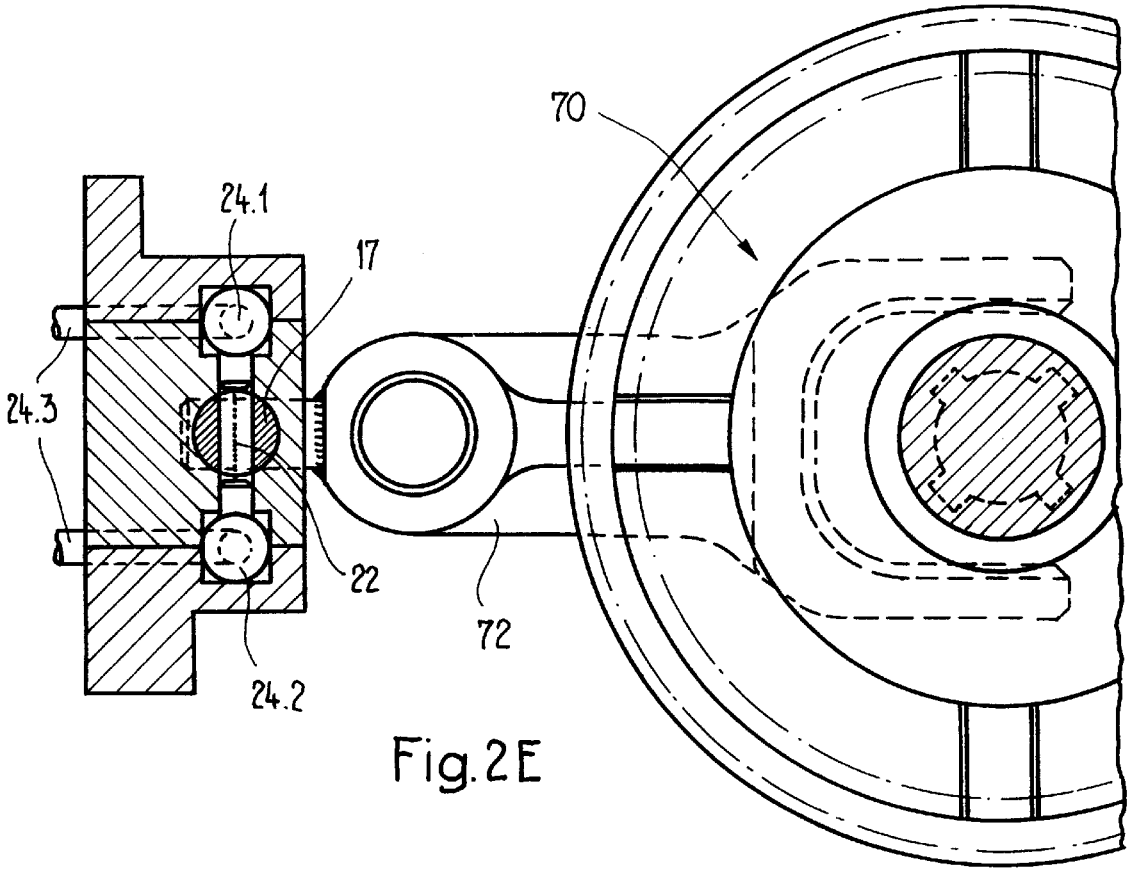
FIG. 2E shows the firearm illustrated in FIG. 1 in a section along the line E–E of FIG. 2, greatly simplified, to illustrate a fifth of the devices of the firearm illustrated in FIG. 2.

FIG. 2E shows the section E—E of FIG. 2 having a fifth arrangement of the device according to the present invention. In this case, the setting of a gear wheel clutch 70 is understood as the state to be monitored. In this case as well, there is double detection of the state, in that the clutch setting ON and the clutch setting OFF are monitored. A movable forked part 72 indicates the setting of the clutch 70 through its position. The pin forms the feeler 16, on one end of which the indicator 17 is implemented. The position of the pin 72 and/or of the indicator 17 is detected by two light barriers, similarly as described with reference to FIG. 2D. Furthermore, FIG. 2E shows an additional monitoring device for the trigger, which is not implemented using a fiber-optic system, but rather using a solenoid. The mode of operation of the device shown in FIG. 2E inside a weapon controller may be seen in FIG. 3, in which the device implemented using the fiber-optic system 24 is indicated using E1 and E2, while the monitoring device implemented using the solenoid is indicated using G.

Figure 2F:
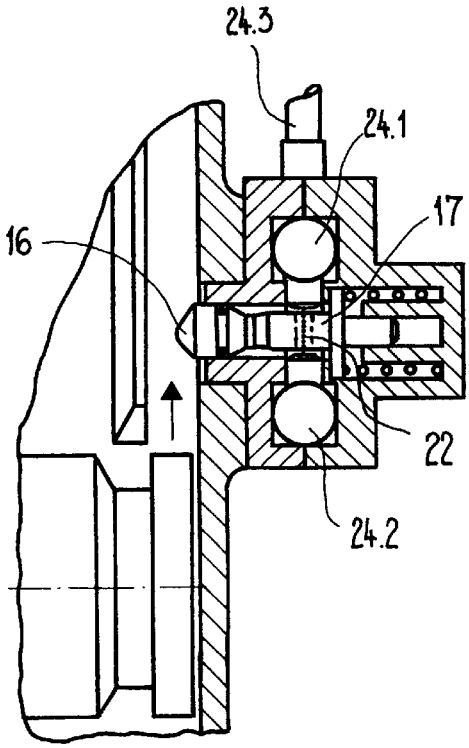
FIG. 2F shows the firearm illustrated in FIG. 1 in a section along the line F—F of FIG. 2, greatly simplified, to illustrate a sixth of the devices of the firearm illustrated in FIG. 2.

In section F—F, FIG. 2F shows a sixth arrangement of one of the devices according to the present invention. In this case, delivery of ammunition into a specific region is understood as the state to be monitored. The arrangement is essentially always identical: a pin, one end of which forms the feeler 16 and the other end of which forms the indicator 17, is positioned movably. Delivered ammunition displaces the pin in FIG. 2F to the right. The mode of operation of the device shown in FIG. 2F within a weapon controller may be seen in FIG. 3, in which it is indicated using F.

Figure 3:
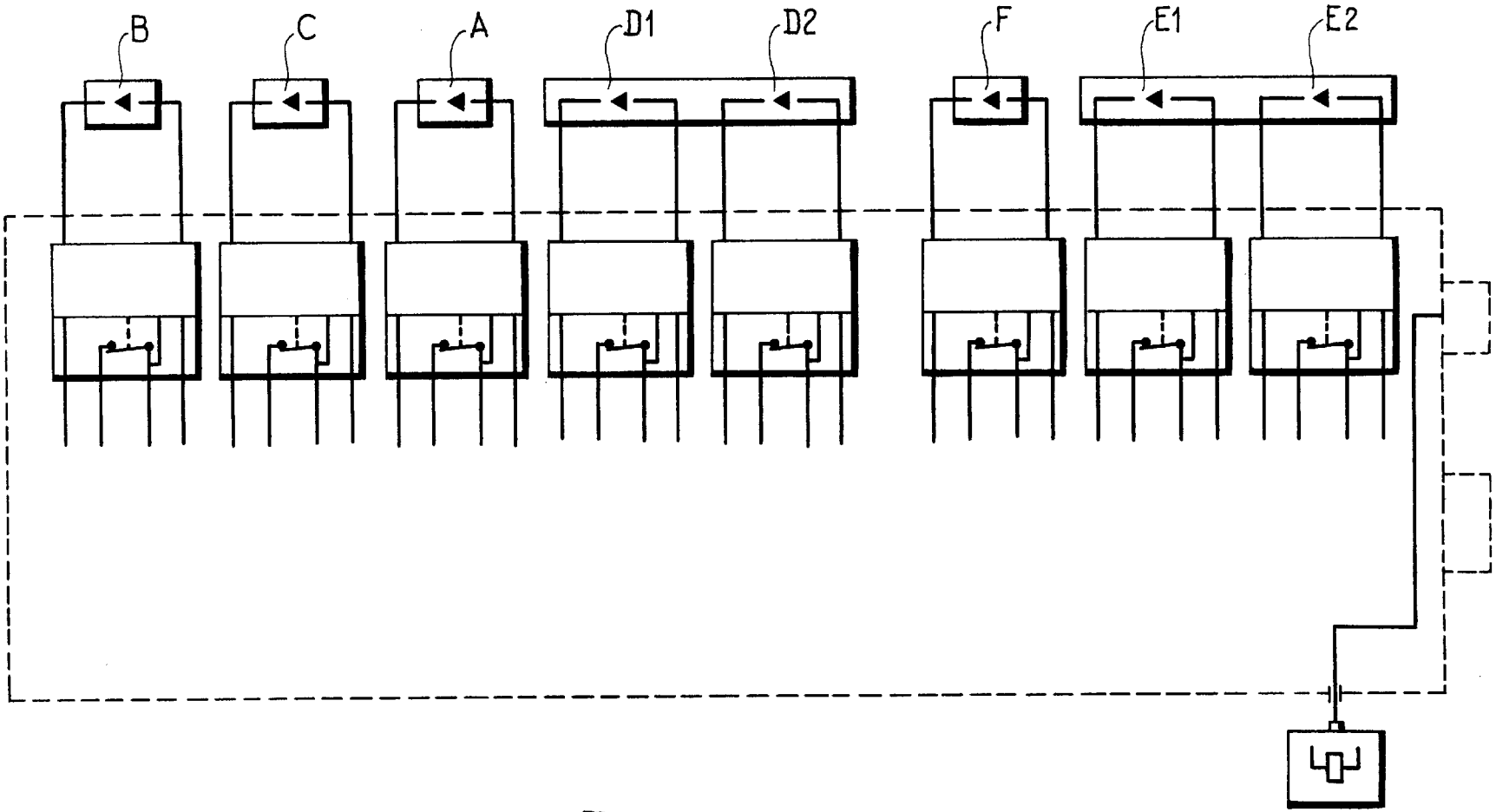
FIG. 3 shows a schematic of a circuit in which the linkages of the devices according to the present invention as shown in FIGS. 2A to 2F are illustrated.

Finally, FIG. 3 schematically shows how the devices according to the present invention as shown in FIGS. 2A to 2F are coupled to one another. The use of the device according to the present invention implemented in this way, which is especially advantageous, is used, as briefly mentioned above, for the purpose of detecting, controlling, or regulating the sequence of various procedures in the firearm.

What is claimed is:

1. A device for firearms, for detecting a state in a space to be monitored and for transmitting a signal correlated to the state, the device comprising:

a sensor region for detecting the state, and having a conductor arrangement connected to the sensor region for transmitting the signal, the sensor region and the conductor arrangement being formed by a fiber optic system, the sensor region of the fiber optic system being shielded by a shielding device, the shielding device being a chamber in which the sensor region is received; and a movable indicator whose position corresponds to the state to be detected in the space to be monitored and which is detectable by the sensor region.

2. The device according to claim 1, wherein the state in the space to be monitored is able to be sensed indirectly by the indicator, the state in the space to be monitored able to be sensed by a feeler, to which the movement of the indicator is able to be coupled at least part of the time.

3. The device according to claim 1, wherein the state in the space to be monitored is able to be sensed directly by a part of the indicator which is not protected by the shielding.

4. The device according to claim 1, wherein the device includes an optical/electronic converter, coupled to the fiber-optic system, for converting the signals provided by the fiber-optic system into an electrical signal.

5. The device according to claim 4, wherein the optical/electronic converter is coupled to a computer unit, which is implemented for the purpose of using the signal provided by the optical/electronic converter.

6. A device for firearms, for detecting a state in a space to be monitored and for transmitting a signal correlated to the state, the device comprising:

a sensor region for detecting the state, and having a conductor arrangement connected to the sensor region for transmitting the signal, the sensor region and the conductor arrangement being formed by a fiber optic system, the sensor region of the fiber optic system being shielded by a shielding device; and a movable indicator whose position corresponds to the state to be detected in the space to be monitored and which is detectable by the sensor region, and wherein a wall of the shielding device has an opening through which a part of the indicator projects movably into the sensor region protected by the shielding device.

7. The device according to claim 6, wherein the opening and the part of the indicator projecting movably through the opening each form a sealing surface, these sealing surfaces lying diametrically opposite one another and forming a sealing device in the opening.

8. The device according to claim 7, wherein one of the sealing surfaces is implemented as a smooth surface and the other sealing surface has a sealing compound, the smooth surface and the sealing compound being intended for the purpose of executing a low-friction relative movement during the movement of indicator through the opening.

9. A device for firearms, for detecting a state in a space to be monitored and for transmitting a signal correlated to the state, the device comprising:

a sensor region for detecting the state, and having a conductor arrangement connected to the sensor region for transmitting the signal, the sensor region and the conductor arrangement being formed by a fiber optic system, the sensor region of the fiber optic system being shielded by a shielding device; and a movable indicator whose position corresponds to the state to be detected in the space to be monitored and which is detectable by the sensor region, the indicator projecting through the shielding device into the sensor region of the fiber optic system protected by the shielding device, and the indicator and the sensor region of the fiber optic system being implemented and positioned in such a way that the position of the indicator is directly detectable by the sensor region.

10. A device for firearms, for detecting a state in a space to be monitored and for transmitting a signal correlated to the state, the device comprising:

a sensor region for detecting the state, and having a conductor arrangement connected to the sensor region for transmitting the signal, the sensor region and the conductor arrangement being formed by a fiber optic system, the sensor region of the fiber optic system being shielded by a shielding device; and a movable indicator whose position corresponds to the state to be detected in the space to be monitored and which is detectable by the sensor region, the indicator projecting through the shielding device into the sensor region of the fiber optic system protected by the shielding device, and the sensor region of the fiber optic system being implemented and positioned in such a way that the position of the indicator is indirectly detectable with the aid of a reflection unit.

11. The device according to claim 10, wherein the reflection unit has at least two reflection surfaces, which are formed by surfaces of indicator parts of the indicator, implemented in multiple parts, which are able to work together.

12. A device for firearms, for detecting a state in a space to be monitored and for transmitting a signal correlated to the state, the device comprising:

a sensor region for detecting the state, and having a conductor arrangement connected to the sensor region for transmitting the signal, the sensor region and the conductor arrangement being formed by a fiber optic system, the sensor region of the fiber optic system being shielded by a shielding device, and wherein the sensor region of the fiber optic system has a light barrier including two light barrier elements; and a movable indicator whose position corresponds to the state to be detected in the space to be monitored and which is detectable by the sensor region.

13. The device according to claim 12, wherein a region of the indicator, which is movable between the light barrier elements and completely screens light, interrupts a light beam of the light barrier to generate the signal.

14. The device according to claim 12, wherein in order to generate the signal, a region of the indicator, which is movable between the light barrier elements and screens light, has an opening to cancel the interruption of the light beam of the light barrier caused by the light-shielding region of indicator.

15. A device for firearms, for detecting a state in a space to be monitored and for transmitting a signal correlated to the state, the device comprising:

a sensor region for detecting the state, and having a conductor arrangement connected to the sensor region for transmitting the signal, the sensor region and the conductor arrangement being formed by a fiber optic system, the sensor region of the fiber optic system being shielded by a shielding device;

a movable indicator whose position corresponds to the state to be detected in the space to be monitored and which is detectable by the sensor region; and at least one further sensor region for detecting the position of the indicator or a further indicator.

16. A device for firearms, for detecting a state in a space to be monitored and for transmitting a signal correlated to the state, the device comprising:

a sensor region for detecting the state, and having a conductor arrangement connected to the sensor region for transmitting the signal, the sensor region and the conductor arrangement being formed by a fiber optic system, the sensor region of the fiber optic system being shielded by a shielding device; and a movable indicator whose position corresponds to the state to be detected in the space to be monitored and which is detectable by the sensor region, the indicator having multiple indicator regions having markings, the markings being detectable alternately by the sensor region of the fiber optic system.

17. A firearm having at least one device for detecting a state in a space to be monitored and for transmitting a signal correlated to the state comprising:

a sensor region for detecting the state, and having a conductor arrangement connected to the sensor region for transmitting the signal, the sensor region and the conductor arrangement being formed by a fiber optic system, the sensor region of the fiber optic system being protected by a shielding device; and a movable indicator whose position corresponds to the state to be detected in the space to be monitored and which is detectable by the sensor region, and wherein the shielding device is a chamber which encloses the protected part of the indicator and the sensor region of the fiber optic system.

18. The firearm according to claim 17, wherein the indicator has a part projecting into the space to be monitored, which is implemented for sensing the position of a movable part of the firearm and the position of the indicator being directly determined by the state to be detected in the space to be monitored.

19. A firearm having at least one device for detecting a state in a space to be monitored and for transmitting a signal correlated to the state, comprising:

a sensor region for detecting the state, and having a conductor arrangement connected to the sensor region for transmitting the signal, the sensor region and the conductor arrangement being formed by a fiber optic system, the sensor region of the fiber optic system being protected by a shielding device;

a movable indicator whose position corresponds to the state to be detected in the space to be monitored and which is detectable by the sensor region; and a feeler implemented for sensing the position of a movable part of the firearm and whose movement is able to be coupled to the indicator at least part of the time, the position of the indicator being indirectly determined by the state to be detected in the space to be monitored.

20. A firearm having at least one device for detecting a state in a space to be monitored and for transmitting a signal correlated to the state, comprising:

a sensor region for detecting the state, and having a conductor arrangement connected to the sensor region for transmitting the signal, the sensor region and the conductor arrangement being formed by a fiber optic system, the sensor region of the fiber optic system being protected by a shielding device; and a movable indicator whose position corresponds to the state to be detected in the space to be monitored and which is detectable by the sensor region, and wherein a wall of the shielding device has an opening through which a part of the indicator projects movably into the sensor region protected by the shielding device.

21. The firearm according to claim 20, wherein the opening and the part of the indicator projecting movably through the opening each form a sealing surface, these sealing surfaces lying diametrically opposite one another and forming a sealing device in the opening.

22. A firearm having at least one device for detecting a state in a space to be monitored and for transmitting a signal correlated to the state, comprising:

a sensor region for detecting the state, and having a conductor arrangement connected to the sensor region for transmitting the signal, the sensor region and the conductor arrangement being formed by a fiber optic system, the sensor region of the fiber optic system being protected by a shielding device; and a movable indicator whose position corresponds to the state to be detected in the space to be monitored and which is detectable by the sensor region, and wherein the state to be detected in the space to be monitored is the setting of a locking element for a weapon barrel of the firearm.

23. A firearm having at least one device for detecting a state in a space to be monitored and for transmitting a signal correlated to the state, comprising:

a sensor region for detecting the state, and having a conductor arrangement connected to the sensor region for transmitting the signal, the sensor region and the conductor arrangement being formed by a fiber optic system, the sensor region of the fiber optic system being protected by a shielding device; and a movable indicator whose position corresponds to the state to be detected in the space to be monitored and which is detectable by the sensor region, and wherein the state to be detected is the setting of a slide moved in synchronization with the cadence, which forms a clock of the firearm.

24. A firearm having at least one device for detecting a state in a space to be monitored and for transmitting a signal correlated to the state, comprising:

a sensor region for detecting the state, and having a conductor arrangement connected to the sensor region for transmitting the signal, the sensor region and the conductor arrangement being formed by a fiber optic system, the sensor region of the fiber optic system being protected by a shielding device; and a movable indicator whose position corresponds to the state to be detected in the space to be monitored and which is detectable by the sensor region, and wherein the state to be detected in the space to be monitored is the occupation by a cartridge of a cartridge chamber located in the firing position.

25. A firearm having at least one device for detecting a state in a space to be monitored and for transmitting a signal correlated to the state, comprising:

a sensor region for detecting the state, and having a conductor arrangement connected to the sensor region for transmitting the signal, the sensor region and the conductor arrangement being formed by a fiber optic system, the sensor region of the fiber optic system being protected by a shielding device; and a movable indicator whose position corresponds to the state to be detected in the space to be monitored and which is detectable by the sensor region, and wherein the state to be detected in the space to be monitored is the setting of a firing pin.

26. A firearm having at least one device for detecting a state in a space to be monitored and for transmitting a signal correlated to the state, comprising:

a sensor region for detecting the state, and having a conductor arrangement connected to the sensor region for transmitting the signal, the sensor region and the conductor arrangement being formed by a fiber optic system, the sensor region of the fiber optic system being protected by a shielding device; and a movable indicator whose position corresponds to the state to be detected in the space to be monitored and which is detectable by the sensor region, and wherein the state to be detected in the space to be monitored is the setting of a clutch.

27. A firearm having at least one device for detecting a state in a space to be monitored and for transmitting a signal correlated to the state, comprising:

a sensor region for detecting the state, and having a conductor arrangement connected to the sensor region for transmitting the signal, the sensor region and the conductor arrangement being formed by a fiber optic system, the sensor region of the fiber optic system being protected by a shielding device; and a movable indicator whose position corresponds to the state to be detected in the space to be monitored and which is detectable by the sensor region, and wherein the state to be detected in the space to be monitored is the state of the delivery of ammunition.

28. A firearm having at least one device for detecting a state in a space to be monitored and for transmitting a signal correlated to the state, comprising:

a sensor region for detecting the state, and having a conductor arrangement connected to the sensor region for transmitting the signal, the sensor region and the conductor arrangement being formed by a fiber optic system, the sensor region of the fiber optic system being protected by a shielding device; and a movable indicator whose position corresponds to the state to be detected in the space to be monitored and which is detectable by the sensor region, and wherein the firearm includes at least two of the devices, which are coupled to one another, in order to monitor, control, or regulate the time sequence of the execution of different functions of the firearm.

* * * * *